US005816207A

United States Patent [19]

Kadokawa et al.

[11] Patent Number: 5,816,207

[45] Date of Patent: Oct. 6, 1998

[54] TAPPET ROLLER BEARING

[75] Inventors: Satoshi Kadokawa; Dai Kinno, both of Fujisawa, Japan

[73] Assignee: NSK Ltd., Tokyo, Japan

[21] Appl. No.: 784,723

[22] Filed: Jan. 16, 1997

Related U.S. Application Data

[63] Continuation of Ser. No. 523,410, Sep. 5, 1995, abandoned.

[30] Foreign Application Priority Data

Sep. 5, 1994 [JP] Japan ..... 6-211402

[51] Int. Cl.[6] ..... F01L 1/16; F01L 1/18

[52] U.S. Cl. ..... 123/90.42; 123/90.5; 123/90.51

[58] Field of Search ..... 123/90.39, 90.41, 123/90.42, 90.48, 90.5, 90.51, 90.6

[56] References Cited

U.S. PATENT DOCUMENTS

| | | | |
|---|---|---|---|
| 3,545,415 | 12/1970 | Mori | 123/90.51 |
| 4,312,900 | 1/1982 | Simpson | 427/181 |
| 4,568,252 | 2/1986 | Hattori et al. | 417/269 |
| 4,871,266 | 10/1989 | Oda | 384/42 |
| 4,872,432 | 10/1989 | Rao et al. | 123/193 CP |
| 4,873,150 | 10/1989 | Doi et al. | 123/90.51 |
| 4,995,281 | 2/1991 | Allor et al. | 123/90.44 |
| 5,159,852 | 11/1992 | Harimoto et al. | 74/559 |
| 5,237,967 | 8/1993 | Willermet et al. | 123/90.51 |
| 5,239,951 | 8/1993 | Rao et al. | 123/90.51 |
| 5,249,554 | 10/1993 | Tamor et al. | 123/90.51 |
| 5,309,874 | 5/1994 | Willermet et al. | 123/90.51 |
| 5,353,756 | 10/1994 | Murata et al. | 123/90.46 |
| 5,427,698 | 6/1995 | Hirokawa et al. | 252/12.4 |

FOREIGN PATENT DOCUMENTS

| | | |
|---|---|---|
| 53-57148 | 5/1978 | Japan . |
| 54-111035 | 8/1979 | Japan . |
| 56-105500 | 8/1981 | Japan . |
| 57-200726 | 12/1982 | Japan . |
| 60-75723 | 5/1985 | Japan . |
| 61-77462 | 5/1986 | Japan . |
| 1-78206 | 5/1989 | Japan . |
| 2-6371 | 2/1990 | Japan . |
| 2-130205 | 5/1990 | Japan . |
| 2-219894 | 9/1990 | Japan . |
| 3-96715 | 4/1991 | Japan . |
| 3-172611 | 7/1991 | Japan . |
| 3-255223 | 11/1991 | Japan . |
| 4-46219 | 2/1992 | Japan . |
| 4-49226 | 4/1992 | Japan . |
| 4-97117 | 8/1992 | Japan . |
| 5-10108 | 1/1993 | Japan . |
| 6-41721 | 2/1994 | Japan . |
| 62-48913 | 9/1994 | Japan . |

*Primary Examiner*—Weilun Lo
*Attorney, Agent, or Firm*—Helfgott & Karas, PC.

[57] ABSTRACT

A surface treatment layer for reducing friction is formed either on the outer peripheral surface of the shaft or on the inner peripheral surface of the roller opposed to the outer peripheral surface of the shaft with a small gap between them, wherein surface damages are prevented by the surface treatment layer from occurring on the outer peripheral surfaces immediately after the engine starts and before the engine oil is supplied.

4 Claims, 3 Drawing Sheets

TAPPET ROLLER BEARING

This is a continuation of application Ser. No. 08/523,410, filed Sep. 5, 1995, now abandoned.

BACKGROUND OF THE INVENTION

1. Field of the Invention

The present invention is related to a tappet roller bearing incorporated into an engine valve drive mechanism for minimizing friction of the valve drive mechanism components, to thereby reduce fuel consumption during engine operation.

2. Description of the Related Art

In general, to reduce friction in an engine and thus reduce fuel consumption, tappet roller bearings are fitted to the mechanism which changes the rotation of a cam shaft synchronized with an engine crank shaft into the reciprocal drive for the intake valve and exhaust valve. FIGS. 1 and 2 show such a tappet roller bearing disclosed in Japanese Utility Model First Publication Kokai No. H3-108806.

In FIGS. 1 and 2, an engine cam shaft 1 which rotates synchronously with the engine crank shaft (not shown), is fitted with a cam 2 (generally formed integrally therewith) which transmits movement to a rocker arm 3 provided opposite to the cam 2.

A pair of support walls 4 are provided on an end portion of the rocker arm 3 in spaced apart relation to each other. A hollow or solid steel shaft 5 spans between the pair of support walls 4. Opposite end portions of the shaft 5 are placed in an unquenched condition, and at the time of fixing the shaft 5, the unquenched end portions of the shaft 5 are crimped or deformed outwards against the inner peripheral surfaces of apertures 18 formed in the pair of support walls 4. In this way, a roller 6 is supported so as to be freely rotatable around the shaft 5, with an outer peripheral surface thereof contacted against the outer peripheral face of the cam 2.

With the tappet roller bearing constructed as described above, the friction force between the rocker arm 3 and the cam 2 is reduced, giving a reduction in fuel consumption at the time of engine operation. During engine rotation, engine oil is supplied to the basic parts of the tappet roller bearing, to thereby effect lubrication between the outer peripheral surface of the cam 2 and the outer peripheral face of the roller 6, and between the outer peripheral face of the shaft 5 and the inner peripheral face of the roller 6.

In general from the point of view of minimizing material and manufacturing costs while maintaining the required material strength, the cam shaft 1 including the cam 2 is made from cast iron or bearing steel, while the roller 6 and the shaft 5 are made from a high carbon chrome bearing steel.

Generally, the lubrication of the rubbing portions of the mating member pairs during engine operation is ensured by suitable design of the clearances between the respective peripheral surface of the member pairs, and of the surface roughness of the respective peripheral faces.

In order to more reliably ensure such lubrication, the shaft 5 can be made from phosphor bronze and the roller 6 made from a high carbon chrome bearing steel.

Moreover, the provision of a lubrication apertures for supplying engine oil to the rocker arm 3 and the shaft 5 has heretofore been proposed, for example in the disclosure of Japanese Utility Model First Publication Kokai No. H4-32210.

Manufacture of the roller 6 using a ceramic such as silicon nitride has also heretofore been proposed, for example in the disclosure of Japanese Patent First Publication Kokai No. H4-15296, Japanese Utility Model First Publication Kokai No. S62-203911, and Japanese Utility Model First Publication Kokai No. H3-108806.

In the case of the heretofore known tappet roller bearing as described above, the following points need to be addressed.

Firstly, if the cam shaft 1, including the cam 2, are made from a cast iron or bearing steel and the shaft 5 and the roller 6 are made from a high carbon chrome bearing steel, then depending on operating conditions, surface damage, referred to as smear, occurs on one or both of the outer peripheral surface of the shaft 5 and the inner peripheral surface of the roller 6, and on one or both of the outer peripheral surface of the cam 2 and the outer peripheral surface of he roller 6.

This type of surface damage arises as a result of the fact that the contact portions on the peripheral surface pairs of the shaft 5 and roller 6, and the contact portions on the outer peripheral surface pairs of the cam 2 and roller 6, are placed in an unlubricated condition at the time of assembly operation. More specifically, there remains oil including processing oil such as cutting fluid which is applied during machining, and rust preventing oil applied to prevent corrosion during transport, such residue oil being attached to the surfaces of the cam 2, shaft 5 and roller 6. If this oil is left as is, then the above mentioned outer peripheral surfaces of the member pairs are lubricated with this residue oil, upon and after starting the engine.

However, in order to prevent contamination of the engine oil when mixed with the residue oil, it has recently become the practice during engine assembly to wash away this residue oil so that the bare minimum remains. Therefore, with the engine washed immediately after assembly, the contact portions of the outer peripheral surfaces of the member pairs are placed in a practically non lubricated condition. When the engine is started from this condition, the peripheral faces of the member pairs are rubbed hard together without lubrication during the short period of time until engine oil is supplied, resulting in surface damage to the respective peripheral surfaces.

When this resultant surface damage is considerable, there is the likelihood of seizure of the contact portions on the outer peripheral surface of the shaft 5 and the inner peripheral surface of the roller 6.

Moreover, even with only slight surface damage causing the formation of minute protuberances on the respective peripheral surfaces, and with a supply of engine oil, these protuberances make it difficult to obtain a lubrication condition with full fluid lubrication of the rubbing portions of the respective peripheral surfaces of the member pairs. As a result, with the increase in surface fatigue of the respective peripheral surface portions over time, or when the oil film formation cannot follow the sudden speed changes which occur with rapid acceleration/deceleration of the engine, there is the likelihood of abnormal local surface damage.

Moreover, tailoring the surface roughness of the peripheral surfaces of the cam 2, shaft 5 and roller 6 is aimed at achieving effective utilization of the supplied engine oil, and not in itself effective in preventing the surface damage under non lubricated conditions.

If an outer peripheral surface of the shaft 5 made of a phosphor bronze and an inner peripheral surface of the roller 6 made of a high carbon chrome bearing steel are brought into contact, the friction of the contact portions can be reduced by a certain amount due to the contact between different types of metal. However, in this case the material and manufacturing costs for the shaft 5 increase, and the effectiveness in preventing surface damage under non lubricated conditions is still inadequate.

Moreover, if the roller 6 is made from a ceramic such as silicon nitride, the material and manufacturing costs for the roller 6 are increased. In addition, not only is the ceramic roller 6 more susceptible to chipping, as compared to the metal alloy roller, but its hard surface is inclined to strongly attack the metal cam 2, so that the outer peripheral surface of the cam 2 is susceptible to considerable wear. Furthermore, due to the lower thermal expansion of the ceramic roller 6 compared to that of the metal shaft 5, there is a large change in the gap between the outer peripheral surface of the shaft 5 and the inner peripheral surface of the roller 6 with starting and stopping of the engine. As a result, when the engine temperature is low, there is the likelihood of problems such as vibration caused in the support region of the roller 6.

SUMMARY OF THE INVENTION

It is therefore an object of the present invention to provide a tappet roller bearing which addresses the above types of problems.

Another object of the present invention is to provide a tappet roller bearing comprising a cam fixed to and moved with a cam shaft which rotates synchronously with an engine crank shaft, and a member assembly opposed to the cam to receive the movements of the cam, the member assembly comprising a pair of support walls formed in spaced apart relation to each other, a shaft spanning between the pair of support walls, a roller supported so as to be freely rotatable around the shaft, and a surface treatment layer for reducing friction, which is formed on the surface of at least one of members which are mated and moved relative to each other with the movements of the cam.

DETAILED DESCRIPTION OF THE PREFERRED EMBODIMENTS

The tappet roller bearing according to the present invention, as with the beforementioned conventional tappet roller bearing, is comprised of a cam fixed to a cam shaft which rotates synchronously with an engine crank shaft, and a member assembly opposed to the cam to receive the movements of the cam, the member assembly comprising a pair of support walls formed in spaced apart relation to each other, a shaft spanning between the pair of support walls, and a roller supported so as to be freely rotatable around the shaft.

Figure 5:
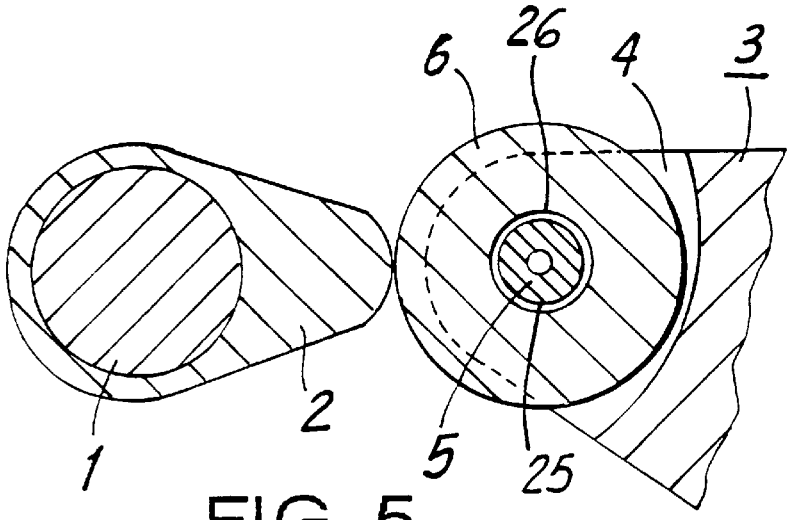
FIG. 5 is a cross sectional view of a tappet roller bearing in accordance with the present invention.

In particular, with the tappet roller bearing according to the present invention, the surface of at least one member of the plurality of mating members which moves relative to each other with rotation of the cam, for example, as shown in FIG. 5, one of be inner peripheral surface of the roller 6 and the outer peripheral surface of the shaft 5, is formed with a surface treatment layer 26 and 25, respectively, for reducing friction. The surface treatment layers 25, 26 for reducing friction may belong to one of the following layers (1) through (5):

(1) A reaction layer of a compound of sulfur and iron, such as sulfurized layer.

(2) A reaction layer of a compound of sulfur and iron compound which includes nitrogen, such as sulfurized/nitrided layer.

(3) A reaction layer of a phosphate compound of phosphorus and iron.

(4) A treatment layer obtained by baking or firing either molybdenum disulfide (MoS2) or polytetrafluoroethylene (PTFE) or a mixture of both, together with a thermosetting synthetic resin.

(5) A composite layer comprising one of the reaction layers of (1) through (3) and a treatment layer obtained by baking or firing either molybdenum disulfide (MoS2) or polytetrafluoroethylene (PTFE) or a mixture of both, together with a thermosetting synthetic resin and overlaid on the one of the reaction layers.

With the tappet roller bearing according to the present invention constructed as described above, lubrication between the rubbing member pairs of components can be sufficiently maintained as a result of the surface treatment layer for reducing friction, even during the period immediately after starting the engine until the engine oil spreads to the tappet roller bearing portions, or even when the engine oil supply does not follow the rapid acceleration/deceleration of the engine. Therefore, surface damage to the surfaces of the beforementioned components can be avoided. As a result, there is no formation of detrimental irregularities on the surfaces of the mating member pairs, so that the lubrication condition of the respective member surfaces can be a favorable full fluid lubrication, enabling an increase in the life of the respective components.

Tests carried out to verify the effect of the present invention will now be described.

Endurance Life Test

First is a description of the first and second tests on the endurance life test.

Figure 3:
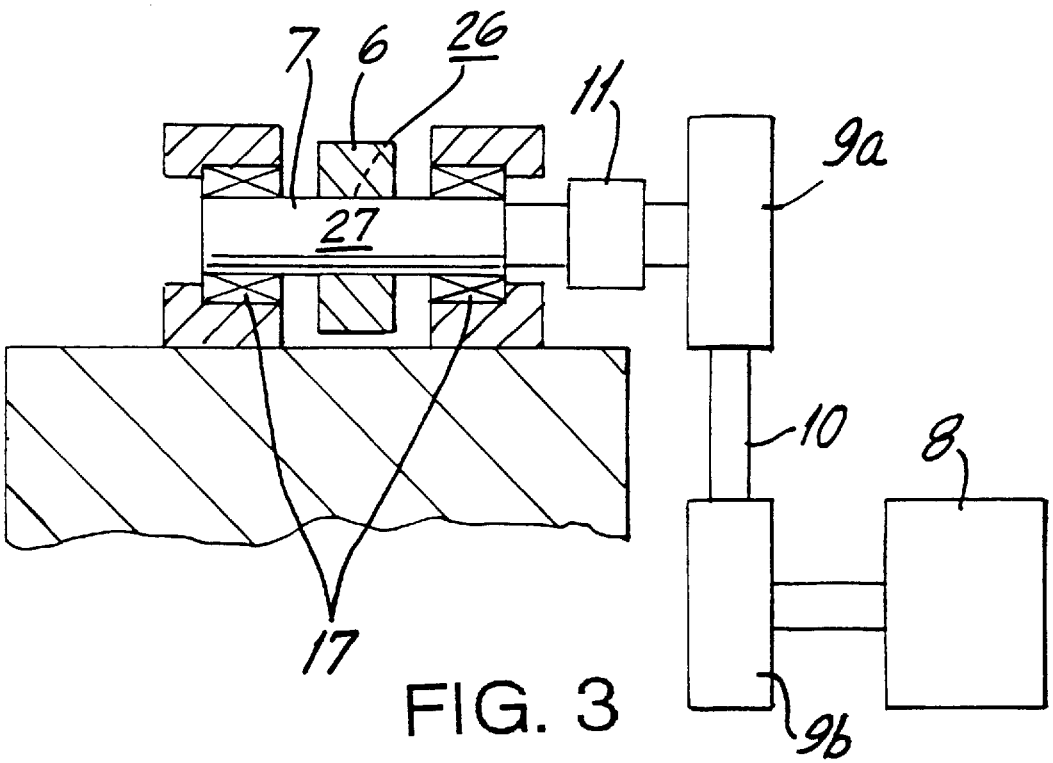
FIG. 3 is a schematic partially sectioned side view of an endurance test rig.

The first and second tests, were carried out on an endurance life test rig as shown in FIG. 3. With this test rig, a roller 6 having an inner peripheral surface, which may comprise treatment layer 26, was supported on an outer peripheral surface at the central portion of a shaft 7 which was rotatably supported by a pair of bearings 17, so as to be freely rotatable relative to the shaft 7. The outer peripheral surface may comprise surface treatment layer 27. The shaft 7 was rotatably driven by means of an electric motor 8 connected by a belt 10 between a pair of pulleys 9*a*, 9*b* to a joint 11.

With this test rig, a radial load was applied to the roller 6, and the useful life of the rubbing portions between the inner peripheral surface of the roller 6 and the outer peripheral surface of the shaft 7 was measured.

The test conditions were as follows,

Diameter of Shaft 7: 10 mm

Material of Shaft 7: SUJ2 (JIS G 4805, high carbon chrome bearing steel)

Surface Hardness of Shaft 7: HRc 61

Inner Diameter of Roller 6; 10.05 mm

Outer Diameter of Roller 6: 30 mm

Width of Roller 6: 8 mm

Material of Roller 6: SUJ2

Surface Hardness of Roller 6: HRc 61

Rotational Speed of Shaft 7: 3000 rpm

Load applied to roller 6: 66 kgf

The first and second tests were all carried out under the above conditions.

The first test was carried out under non lubricated conditions (dry) with no lubricating oil supplied to the outer peripheral surface of the shaft 7 or the inner peripheral surface of the roller 6.

With the second test, three micro liters of engine oil (SE type, 10W-30) was supplied by a micro syringe between the outer peripheral surface of the shaft 7 and the inner peripheral face of the roller 6, so that there was a very slight amount of lubrication between the outer peripheral face of the shaft 7 and the inner peripheral face of the roller 6.

The life of the rubbing portions was taken as the shorter of the time until the temperature of the roller 6 reached 160 degrees Celsius, or the current value of the electric motor 8 reached an excessive amount. Specifically, the test was terminated when one or other of the times mentioned above was reached, and the elapsed time taken as the endurance life.

The results for the first and second tests carried out as described above are given respectively in Table 1 for the first test and in Table 2 for the second test.

TABLE 1

| Specimen No. | Surface treatment | Lubrication | Treated Part | Endurance Life | Surface peel |
|---|---|---|---|---|---|
| Test Example 1-A | Phosphating | Dry | Shaft | $0.08 \times 10^5$ | Yes |
| Test Example 1-B | Sulphurizing | Dry | Shaft | $0.04 \times 10^5$ | Yes |
| Test Example 1-C | Sulphurizing /Nitriding | Dry | Shaft | $0.36 \times 10^5$ | No |
| Test Example 1-D | $MoS_2$/PTFE baked film | Dry | Shaft | $0.48 \times 10^5$ | No |
| Test Example 1-E | phosphating + $MoS_2$ /PTFE baked film | Dry | Shaft | $3.23 \times 10^5$ | No |
| Test Example 1-F | Sulphurizing + $MoS_2$ /PTFE baked film | Dry | Shaft | $1.93 \times 10^5$ | No |
| Test Example 1-G | Sulphurizing /Nitriding + $MoS_2$ /PTFE baked film | Dry | Shaft | $2.11 \times 10^5$ | No |
| Comparative Example 1-H | SUJ2 (shaft, roller) untreated | Dry | — | $0.01 \times 10^5$ | Yes |
| Comparative Example 1-I | Ceramic (shaft) SUJ2 (roller) | Dry | — | $0.01 \times 10^5$ | Yes |
| Test Example 1-J | Phosphating | Dry | Roller | $0.06 \times 10^5$ | Yes |
| Test Example 1-K | Sulphurizing | Dry | Roller | $0.03 \times 10^5$ | Yes |
| Test Example 1-L | Sulphurizing /Nitriding | Dry | Roller | $0.08 \times 10^5$ | No |
| Test Example 1-M | $MoS_2$/PTFE baked film | Dry | Roller | $0.26 \times 10^5$ | No |
| Test Example 1-N | Phosphating + $MoS_2$ /PTFE baked film | Dry | Roller | $2.88 \times 10^5$ | No |
| Test Example 1-O | Sulphurizing + $MoS_2$ /PTFE baked film | Dry | Roller | $1.59 \times 10^5$ | No |
| Test Example 1-P | Sulphurizing /Nitriding + $MoS_2$ /PTFE baked film | Dry | Roller | $1.99 \times 10^5$ | No |
| Comparative Example 1-Q | Ceramic (roller) SUJ2 (shaft) | Dry | — | $0.02 \times 10^5$ | Yes |

TABLE 2

| Specimen No. | Surface treatment | Lubrication | Treated Part | Endurance Life | Surface peel |
|---|---|---|---|---|---|
| Test Example 2-A | Phosphating | 3 μl | Shaft | $1.11 \times 10^5$ | No |
| Test Example 2-B | Sulphurizing | 3 μl | Shaft | $0.75 \times 10^5$ | No |
| Test Example 2-C | Sulphurizing /Nitriding | 3 μl | Shaft | $1.61 \times 10^5$ | No |
| Test Example 2-D | $MoS_2$/PTFE baked film | 3 μl | Shaft | $0.52 \times 10^5$ | No |
| Test Example 2-E | Phosphating + $MoS_2$ /PTFE baked film | 3 μl | Shaft | $3.87 \times 10^5$ | No |
| Test Example 2-F | Sulphurizing + $MoS_2$ /PTFE baked film | 3 μl | Shaft | $2.30 \times 10^5$ | No |
| Test Example 2-G | Sulphurizing /Nitriding + $MoS_2$ /PTFE baked film | 3 μl | Shaft | $2.89 \times 10^5$ | No |
| Comparative Example 2-H | SUJ2 (shaft, roller) untreated | 3 μl | — | $0.03 \times 10^5$ | Yes |
| Comparative Example 2-I | Ceramic (shaft) SUJ2 (roller) | 3 μl | — | $0.04 \times 10^5$ | Yes |
| Test Example 2-J | Phosphating | 3 μl | Roller | $0.80 \times 10^5$ | No |
| Test Example 2-K | Sulphurizing | 3 μl | Roller | $0.74 \times 10^5$ | Yes |
| Test Example 2-L | Sulphurizing /Nitriding | 3 μl | Roller | $1.03 \times 10^5$ | No |
| Test Example 2-M | $MoS_2$/PTFE baked film | 3 μl | Roller | $0.69 \times 10^5$ | No |
| Test Example 2-N | Phosphating + $MoS_2$ /PTFE baked film | 3 μl | Roller | $3.22 \times 10^5$ | No |
| Test Example 2-O | Sulphurizing + $MoS_2$ /PTFE baked film | 3 μl | Roller | $1.93 \times 10^5$ | No |
| Test Example 2-P | Sulphurizing /Nitriding + $MoS_2$ /PTFE baked film | 3 μl | Roller | $2.11 \times 10^5$ | No |
| Comparative Example 2-Q | Ceramic (roller) SUJ2 (shaft) | 3 μl | — | $0.02 \times 10^5$ | Yes |

In Tables 1 and 2 which give the test results of the first and second tests, the heading in the specimen number shows test examples belonging to the present invention as "Test Example" and comparative examples outside the scope of the present invention as "Comparative Example".

The specimens with the letters A through Q in the specimen number are the same type for first and second tests. The specimens of the present invention indicated by A, B, C, and J, K, L belong to one of the layers (1) through (3) of the beforementioned layers (1) through (5), those indicated by D and M belong to layer (4), and those indicated by E, F, G, and N, O, P belong to layer (5).

"Treated Part" in the tables is the part formed with the surface treatment layer for reducing friction, wherein "Shaft" means that the shaft 7 is provided with a surface treatment layer 27 on its outer peripheral surface, while "Roller" means that the roller 6 is provided with a surface treatment layer 26 on its inner peripheral face.

The units for "Endurance Life" are the total revolutions.

From the results of the first tests shown in Table 1, the following points are evident:

(1) The test examples of the present invention have more than twice the life of the comparative examples with no surface treatment layer.

(2) Surface damage, referred to as smear, occurred on all of the comparative examples, while this only occurred on test examples A, B, and J, K belonging to layers (1) through (3) according to an aspect of the present invention.

(3) With test examples D and M belonging to layer (4) according to an aspect of the present invention, not only was the endurance life longer, but there was no occurrence of surface damage.

(4) With test examples E, F, G, and N, O, P belonging to layer (5) according to an aspect of the present invention, not only was the endurance life sufficiently long, but there was also no occurrence of surface damage.

From the above points (1) through (4), it is evident that with no lubrication (dry), the friction reduction effect due to the slippery contact surface of the molybdenum disulfide or polytetrafluoroethylene, which is solid lubricant, was significant, verifying the effectiveness of these solid lubricants in preventing surface damage.

In particular, with the treatment layers E and N with a surface of a reaction layer of a phosphate compound of manganese phosphate and iron overlaid with a treatment layer obtained by baking or firing either molybdenum disulfide (MoS2) or polytetrafluoroethylene (PTFE) or a mixture of both, together with a thermosetting synthetic resin, it was verified that the endurance life was particularly increased.

With the test examples, manganese phosphate was used to make the phosphate combined with iron. However a similar effect was obtained using zinc phosphate.

Moreover, as is apparent from a comparison of test examples N, O and P with surface treatments obtained by baking, the surface treated with a phosphating treatment which does not reduce the surface hardness in the test examples is desirable from the point of view of endurance life. In the Test examples, a manganese phosphate salt treatment was used as the phosphating treatment, but a zinc phosphate treatment gives the same results. In particular, a surface treatment with a thermosetting synthetic resin having a high thermal stability polyamideimide as a binder, is especially desirable.

Figure 1:
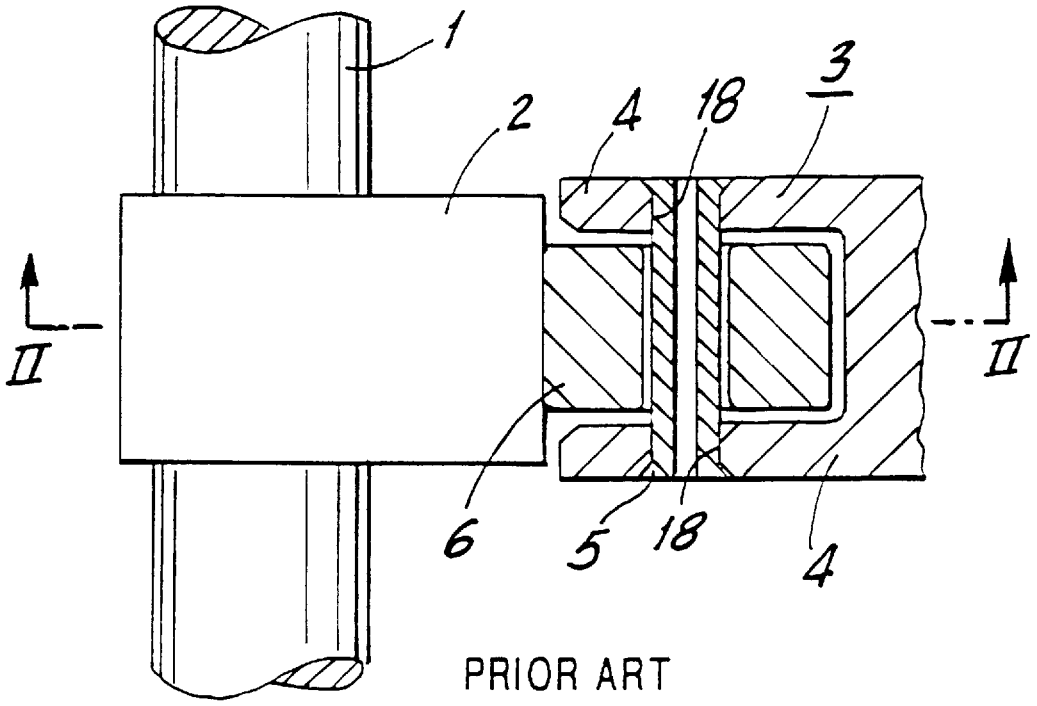
PRIOR ART FIG. 1
FIG. 1 is a partial cross sectional plan view of a prior art tappet roller bearing.
Figure 2:
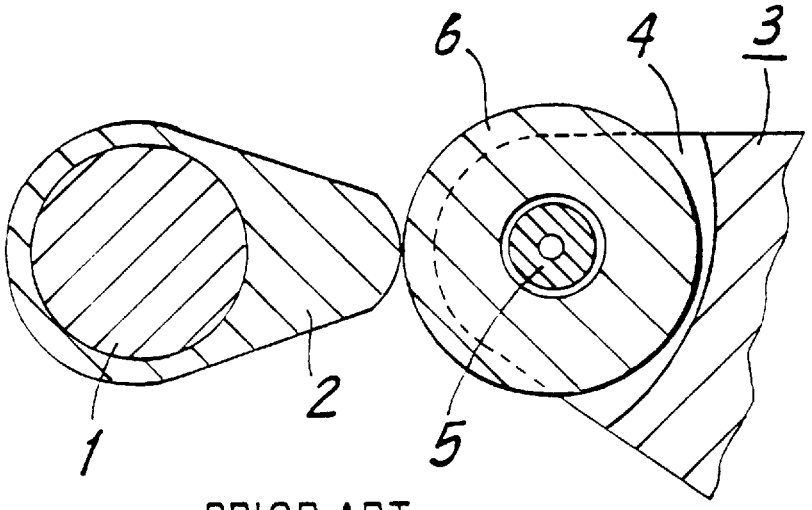
PRIOR ART FIG. 2
FIG. 2 is a cross sectional view on II—II of FIG. 1.

Furthermore, as is apparent from a comparison of test examples A through G and J through P, the surface formed with the surface treatment layer for reducing friction (if formed on one or the other of the surfaces), is preferably formed on the outer peripheral face of the shaft 7, being the surface on the drive side. Accordingly, in actual an embodiment of a tappet roller bearing as shown in FIGS. 1 and 2, the surface treatment layer 26 is preferably formed on the inner peripheral surface of the roller 6. The inner peripheral surface of the roller 6 is the drive side relative to the shaft 5 of FIGS. 1 and 2.

From the results of the second tests shown in Table 2, carried out with a slight amount of lubrication, the following points are evident:

(1) The endurance life was longer than that for the non lubricated condition, and none of the test examples of the present invention showed surface damage.

(2) With test examples A, B, C, and J, K, L belonging to the beforementioned layers (1) through (3) according to an aspect of the present invention, with the exception of test examples B and K wherein sulfurizing treatment had been carried out, there was a tendency for a longer endurance life compared to test examples D and M belonging to the beforementioned layer (4) according to an aspect of the present invention.

That is to say, with the slight amount of lubrication, the reaction layers (1) through (3) of iron, sulfur, nitrogen, phosphorus and the like had a greater improvement in friction reduction effect than the layer (4) with a solid lubricant of baked or fired film. In particular, the endurance life of test example C, with an outer peripheral surface of the shaft 7 subjected to a sulfurizing/nitriding treatment, was longer than that of the other examples.

(3) With test examples E, F, G, and N, O, P belonging to layer (5) according to an aspect of the present invention, the endurance life was sufficiently long.

From a comparison of Table 1 showing the test results for the non-lubricated condition, and Table 2 showing the test results with the slight amount of lubricant, the following points are evident:

(1) In Table 1, showing the results for the non lubricated condition, the solid lubricant of baked or fired film belonging to the beforementioned layer (4) gave an excellent effect from both points of view in relation to improving endurance life and preventing surface damage. However under the slight lubrication condition, the reaction layer of a compound of iron and sulfur, or the reaction layer of a phosphate-compound and iron were effective from the point of view of improving endurance life.

(2) More specifically, with the solid lubricant of baked or fired film of layer (4), a significant effect can be obtained under the non lubricated condition until the supply of engine oil is supplied, while with the reaction layers of (1) and (3), a significant effect can be obtained under conditions of slight lubrication with an insufficient engine oil supply.

(3) Accordingly, with the composite surface treatment layer (5) with the reaction layers of (1) and (3) overlaid with the solid lubricant of baked or fired film of layer (4), a sufficient effect can be obtained over a long period from immediately after commencing engine operation.

Surface Damage Reproduction Test

Figure 4:
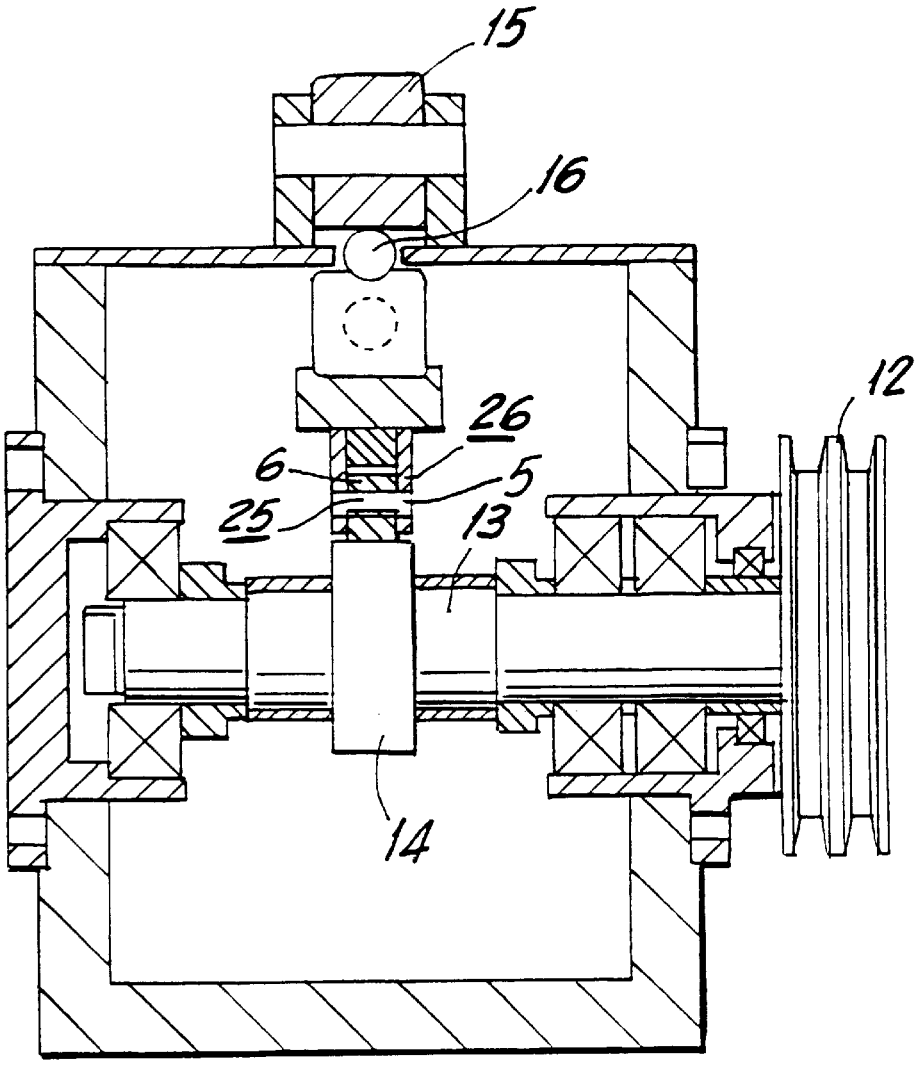
FIG. 4 is a vertical sectional view of a surface damage test rig.

The results of tests to reproduce surface damage on a test bench duplicating actual operating conditions will now be described. These tests were carried out using a surface damage test rig such as shown in FIG. 4. With this test rig, a ring 14 with an outer diameter of 20 mm was press fitted onto the central portion of a shaft 13 which was rotated by a pulley 12. The ring 14 corresponds to the cam 2 (FIGS. 1 and 2). A roller 6 having an inner peripheral surface treatment layer 26 pressed against the outer peripheral surface of the ring 14, had an inner diameter of 8.82 mm, an outer diameter of 20 mm and a width of 8 mm, and was rotatably supported on a shaft 5 having an outer diameter of 8.8 mm. The roller 6 and the shaft 5 were both made from SUJ2 with a surface hardness of HRc 62. In the cases where surface treatment was used to reduce friction, this was carried out over the whole surface of the roller 6.

At the time of the tests, the shaft 13 was rotated at 3000 rpm while pressing the roller 6 against the outer peripheral surface of the ring 14 under a load of 1000 kgf, by means of a load lever 15 acting on a steel ball 16.

The region between the inner peripheral surface of the roller 6 and the outer peripheral surface of the shaft 5 was non lubricated, while a minimum amount of engine oil to prevent seizure was dripped between the outer peripheral surface of the roller 6 and the outer peripheral surface of the ring 14.

The endurance time was obtained as the time until any surface damage occurred on the inner peripheral surface of the roller 6, so that the temperature of the roller 6 increased abnormally, or that severe vibration occurred, or the time until the current of the electric motor for driving the shaft 13 became excessive.

The results are shown in the following Table 3.

In Table 3, the heading in the specimen number shows test examples belonging to the present invention as "Test Examples" and a comparative example outside the scope of the present invention as "Comparative Example". The letters C, D, E and H, after the specimen number, correspond to those of Tables 1 and 2 (examples with the same symbols have the same surface treatment).

As is apparent from the test results of Table 3, the surfaces of the present invention improved the life under non lubrication conditions, and of these, the surface subjected to the beforementioned surface treatment of layer (5) shown as test E, gave a superior result.

TABLE 3

| Specimen No. | Surface treatment | Treated Part | Endurance Life | Surface peel |
|---|---|---|---|---|
| Test Example 3-C | Sulphurizing /Nitriding | Roller | 23 min | Yes |
| Test Example 3-D | $MoS_2$/PTFE baked film | Roller | 17 min | Yes |
| Test Example 3-E | Phosphating + $MoS_2$/PTFE baked film | Roller | 2.2 hrs | No |
| Comparative Example 3-H | SUJ2 (shaft, roller) untreated | Roller | 2 min | Yes |

With the surface treatment layers according to the present invention, not only can these be formed on one of both of the outer peripheral surface of the shaft 5 as treatment layer 25 and the inner peripheral surface of the roller 6 as treatment layer 26, but they can also be formed on one or both of the outer peripheral surface of the cam 2 (not shown) and the outer peripheral surface of the roller 6 (not shown).

The technical scope of the present invention thus covers a tappet roller bearing wherein a surface treatment layer is only formed on one or both of the outer peripheral faces of the cam 2 and roller 6 as a technique for preventing surface damage to both of these outer peripheral faces, and improving the endurance life.

With the tappet roller bearing of the present invention constructed and operated as described above, surface damage under initial conditions when the engine is first started can be avoided, so that not only can seizure be prevented, but also due to the subsequent favorable lubrication conditions sufficient endurance can be ensured.

What is claimed is:

1. A tappet roller bearing comprising:

a cam fixed to and moved with a cam shaft which rotates synchronously with an engine crank shaft, and a member assembly coupled with the cam to receive the movements of the cam, the member assembly comprising a pair of support walls formed in spaced apart relation to each other, a shaft spanning between the pair of support walls and having an outer peripheral surface, and a metal roller supported so as to be freely rotatable around the shaft and having an inner peripheral surface, such that the outer peripheral surface of the shaft is mated to the inner peripheral surface of the roller and that at least the inner peripheral surface of the roller is formed with a surface treatment layer for reducing friction, the surface treatment layer comprising a phosphated layer formed on the inner peripheral surface of the roller and a layer selected from the group of $MoS_2$, PTFE, and mixtures thereof, and bonded to the phosphated layer by a thermosetting synthetic resin.

2. The tappet roller bearing according to claim 1, wherein said surface treatment layer includes a phosphate compound being one of zinc phosphate or manganese phosphate.

3. The tappet roller of claim 1, wherein the phosphated layer is made by applying one of manganese phosphate and zinc phosphate to the inner peripheral surface.

4. A tappet roller bearing comprising:

a cam having an outer peripheral surface and fixed to and moved with a cam shaft which rotates synchronously with an engine crank shaft, and a member assembly coupled with the cam to receive the movements of the cam, the member assembly comprising a pair of support walls formed in spaced apart relation to each other, a shaft spanning between the pair of support walls and having an outer peripheral surface, and a metal roller supported so as to be freely rotatable around the shaft and having an inner peripheral surface, such that the outer peripheral surface of the shaft is mated to the inner peripheral surface of the roller and that at least the inner peripheral surface of the roller is formed with a surface treatment layer for reducing friction, the surface treatment layer comprising a sulfurized layer formed on the inner peripheral surface of the roller and a layer selected from the group of $MoS_2$, PTFE, and mixtures thereof, and bonded to the sulfurized layer by a thermosetting synthetic resin.

* * * * *